United States Patent [19]

Mette

[11] 4,156,444

[45] May 29, 1979

[54] FILLING DEVICE FOR THE BOTTLING OF CARBONATED BEVERAGES

[76] Inventor: Manfred Mette, Rauchschwalbenweg 24, 2000 Hamburg 73, Fed. Rep. of Germany

[21] Appl. No.: 851,600

[22] Filed: Nov. 14, 1977

[51] Int. Cl.[2] ..... B65B 3/04

[52] U.S. Cl. ..... 141/286; 141/302; 141/367; 222/564; 239/468

[58] Field of Search ..... 137/625.38; 141/285, 141/286, 367, 368, 392, 301, 302; 222/486, 564; 239/446, 468

[56] References Cited

U.S. PATENT DOCUMENTS

| | | | |
|---|---|---|---|
| 3,182,916 | 5/1965 | Schulz | 239/468 |
| 3,500,879 | 3/1970 | Meyer | 141/286 X |
| 3,771,728 | 11/1973 | Polnauer | 239/468 |
| 3,964,516 | 6/1976 | Purton et al. | 137/625.38 |
| 4,026,475 | 5/1977 | Vicard | 239/468 |

*Primary Examiner*—Richard E. Aegerter
*Assistant Examiner*—Frederick R. Schmidt
*Attorney, Agent, or Firm*—James R. Cypher

[57] ABSTRACT

The device includes a housing having an inlet opening which supplies fluid essentially tangentially through a short passage to a chamber being approximately spiral-shaped. The chamber surrounds the axis of a discharge opening located in the bottom of the housing. The spiral chamber imparts an angular momentum to the fluid causing the fluid to flow evenly down the inside face of the outer wall of the container.

4 Claims, 2 Drawing Figures

Fig. 1
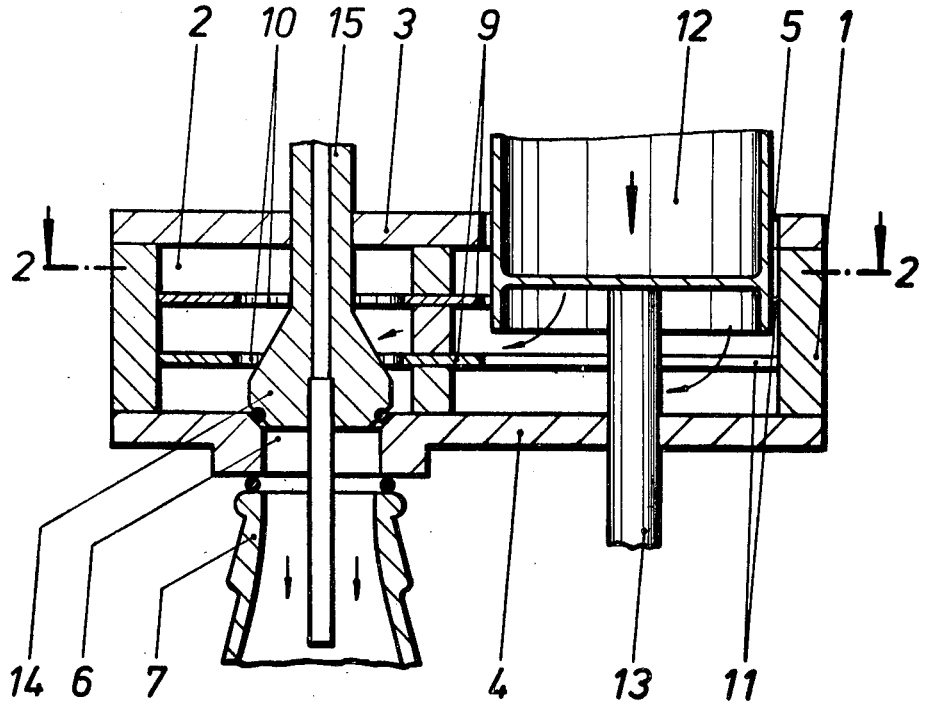
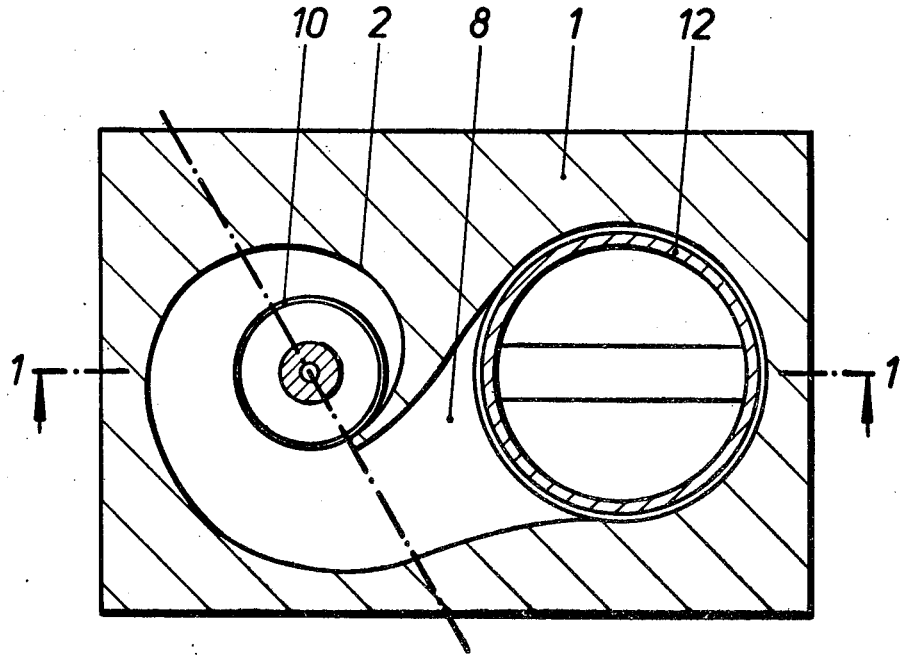
Fig. 2

FILLING DEVICE FOR THE BOTTLING OF CARBONATED BEVERAGES

BACKGROUND OF THE INVENTION

In the art of filling narrow necked bottles with liquid, particularly carbonated liquids, the liquid must be discharged into the neck of the bottle so that the air present in the bottle may escape without disturbing the entering stream of liquid. More importantly, the liquid must be discharged into the bottle with as little turbulence as possible so as to minimize disturbing the liquid.

It is common knowledge to pour the contents of a carbonated liquid from a bottle down the sides of a tall glass to minimize the loss of carbonation. Some effort has been made to fill bottles by causing the liquid to flow down the inside walls of the bottle rather than to simply enter the bottle and strike the bottom wall or discharge into the contents of the partially filled bottle. Publication DT-GM 72 38 305 describes a filling device having a chamber of circular cross section. Fluid enters the device through a channel which discharges the fluid tangentially onto the circular wall of the chamber. As the fluid on entering the chamber changes direction, it flows in a spiral path and thereby acquires a certain amount of angular momentum. Because the spiral path is very short, the angular momentum is not very great and the swirling component quickly disappears along the circular chamber. Only a small portion of the fluid continues the swirling motion down the sidewall of the container. In addition, different components of the fluid flow are discharged from the opening at different angular velocities so that turbulence results at the mouth of the bottle and continues throughout the travel down into the bottle.

Another design used to impart a torsional flow is the use of metal guides similar to turbine blades. Such guides with their numerous edges disturb the smooth flow and cause a plurality of eddy currents to develop. Further the metal guides are difficult to clean. Because the chamber in this device is also circular, as stated previously, only a limited angular velocity is imparted by the guides and the angular component is quickly lost after the liquid enters the container. The plurality of blades divide the flow into a plurality of streams having different angular velocities which result in turbulence as the flows intermix at different velocities and angles of discharge.

SUMMARY OF THE INVENTION

The gist of the present invention is the use of a chamber approximating a spiral case which produces a smooth rotational fluid flow. The liquid flowing into the container has sufficient angular momentum that the centrifugal force imparted to the fluid causes it to flow evenly down the wall of the container. The advantages of such a flow pattern are obvious. Turbulence of the fluid is minimized as it joins the fluid already in the bottle and air within the bottle which is displaced by the entering liquid can travel up through the center of the bottle with a minimum of contact with the entering fluid.

This makes it possible to fill any type of liquid into a bottle faster using the device of the present invention.

These objects are obtained by a design in which the radial cross section of the chamber, which is defined by the projection of the discharge opening and the chamber wall is steadily reduced in the direction of the flow from the cross section at the inlet to almost zero at the outlet over an angle of about 360°. Because the area of the radial cross section of the chamber decreases in this manner, the portion of the flow out the discharge opening corresponds to this decrease in area, thus ensuring a constant angular momentum of the flow through the entire chamber. An ideal flow is developed, yielding a discharge into the container which is rotationally symmetrical and has a high angular momentum. since there are no disruptive narrow points or guides in the chamber, the flow is smooth and delivers maximum liquid to the container. The filling device is very simple in construction and therefor economical to produce. because of its smooth-walled construction, without inset pieces in the chamber, it can be easily and thoroughly cleaned.

the filling device of the invention has the further advantage that the top and bottom surfaces of the chamber are level and parallel to each other. For this reason, they are economical to produce. In this design, the side wall follows the form of a logarithmic spiral, since this type of spiral yields the ideal cross-sectional area at every point in the spiral-shaped flow pattern, when the other bounds of the chamber are parallel.

The filling device of the invention has the further advantage that the effective height of the chamber is adjustable. Adjusting the height of the chamber changes the degree of the angular momentum so that the filling device can be used with various containers, which may require different degrees of angular momentum for ideal filling.

The filling device of the invention has the further advantage that the chamber has at least one dividing wall, approximately parallel to the top and bottom surfaces, which has an opening in approximate alignment with the outlet opening in the bottom. The various levels separated by such a wall can be closed off to the flow individually. The chamber is thus divided into several levels, which are parallel and characterized by similar flow patterns. When individual levels are closed off, the pattern of flow in the remaining levels remains essentially unchanged. The angular momentum of the discharged liquid is merely altered in relation to the number of levels not in use.

The filling device of the invention has the final advantage that a slide valve permitting the passage of fluid may be mounted in either the top or bottom of the chamber. This tube is vertically adjustable and its outside wall seals against the inlet opening and an appropriate opening in the dividing wall. Adjustment of the valve permits effective closing of the individual levels of the chamber, and supply of the device can be from above or below.

BRIEF DESCRIPTION OF THE DRAWINGS

FIG. 1 shows a vertical section through a filling device as in the invention along the line 1—1 in FIG. 2.

FIG. 2 shows a horizontal section along line 2—2 in FIG. 1.

DESCRIPTION OF THE INVENTION

The chamber is bounded on the sides by a sidewall 2 formed in a housing 1. The housing is sealed by a top wall 3 and a bottom wall 4, which are joined to the housing 1 by appropriate means not illustrated here. An inlet opening 5 is located in the top wall 3, and a discharge opening 6 not aligned with it is located in the bottom wall 4. The chamber is positioned with the area of the inlet opening 5 in the top wall 3 under a supply tube, not illustrated, or directly under the discharge opening of a vat. The discharge opening 6 is positioned above an appropriate filling location, where a bottle 7 which is to be filled can be brought into contact with the device, sealing against the bottom edge of the discharge opening 6.

In the vertical plane, the side wall is essentially parallel, and in the horizontal it follows a spiral-shaped course over 360°. Thus the spiral begins and ends at the broken line in FIG. 2. At its inner end, the spiral has approximately the width of the discharge opening, and at its outer end, it leads into an antechamber 8, from which the spiral-shaped space is supplied and over which the inlet opening 5 is located in the example illustrated.

In the example illustrated, the top wall 3 and the bottom wall 4 are horizontal and parallel. In this case, the side wall 2 preferably has the form of a logarithmic spiral. When the two walls are parallel, the logarithmic spiral yields the appropriate speed of flow for any point on the spiral.

The chamber is subdivided into individual levels by dividing walls 9 which are parallel to the top and bottom walls. The dividing walls 9 have openings 10 aligned with the discharge opening 6 and openings 11 aligned with the inlet opening 5.

The inlet opening 5 and the openings 11 aligned with it can, in principle, have any cross section desired. In the example illustrated these openings are circular for the sake of simplicity. A sleeve valve 12 is mounted in these vertically aligned openings, so that its outer wall seals the openings 5 and 11. The sleeve valve 12 can be operated by a rod 13, which is attached to a cross member in the sleeve and mounted in a guide in the bottom wall 4 aligned with the axis of the sleeve. In its highest position the sleeve valve 12 extends above the top wall 3 into the supply pipe or vat, not illustrated, which is connected to the inlet opening 5.

When the sleeve valve 12 is in its highest position, in which its lower edge meets the top wall of the chamber, the liquid which is to be dispensed can pass through the valve into all levels of the chamber. In the position illustrated in FIG. 1, the sleeve valve 12 has been lowered to close off the upper level and permit flow only to the lower levels. If the valve is moved to its lowest position, in which it rests on the bottom wall 4, the whole chamber is closed off to the flow.

Closing off individual levels permits step-by-step reduction of the cross section of flow and thereby reduction of the angular momentum of the liquid in the discharge opening 6. In the example illustrated, the chamber is divided into three levels by two dividing walls 9. The chamber can also be divided into two levels or more than three.

The filling device illustrated in the figures is provided with a shutoff valve, which has a head 14 capable of closing from inside the discharge opening 6. The valve shaft 15 passes through the top wall 3 and extends past the latter. The openings 10 in the dividing walls 9, which are aligned with the discharge opening 6, are larger in diameter than the discharge opening 6, so that the valve head 14 and the liquid pouring around it can pass through them. For the same reason, it is best if the side wall 2 at the inner end of the spiral has the same distance from the axis as the edges of these openings 10. This provision does not lead to a noticeable disruption of the flow pattern.

It is possible to have other versions of the chamber, which may differ from the example illustrated not only in the number of levels but also in the arrangement of the inlet openings. The inlet opening can be moved to the bottom without affecting the feature of step-by-step control of the angular momentum. In this case a sleeve valve will still be used. The inlet opening can also be in the side wall; the supply to the various levels being controlled by a sliding gate. Such an arrangement is simpler than the sleeve valve in the example illustrated. It also involves, however, greater difficulties in sealing the opening.

Given constant differential pressure of the flowing liquid, the spiral chamber filling device of the invention yields a lower value of angular momentum when the cross-sectional area is increased; and lowered angular momentum allows more liquid to flow through. Momentum and flow are thus inversely related when the cross-sectional area varies, which is well suited to the demands placed on such a device. Small bottles, because of their smaller volume, need a slower filling speed and a greater angular momentum for smooth filling.

I claim:

1. A filling device for dispensing carbonated liquid beverages into a container having an inlet opening positioned below said device comprising:

a. a housing formed with a top wall (3), bottom wall (4) and side wall (2) and having an inlet opening (5) and a circular discharge opening (6) having an axis at its centerline and located in said bottom wall and having a diameter substantially equal to said container inlet opening;

b. a discharge opening projection area defined by a series of parallel lines extending from said discharge opening to said top wall;

c. a spiral chamber surrounding said axis of said discharge opening (6) and formed by said sidewall (2) having a spiral shape said top wall (3), and said bottom wall (4) and formed with a chamber inlet opening;

d. a chamber radial cross sectional area defined by said side wall (2), top wall (3), bottom wall (4) and said projection area;

e. a conduit (8) communicating with said inlet opening (5) and communicating tangentially with said side wall (2) of said chamber at said chamber inlet opening;

f. said chamber is dimensioned so that said chamber cross sectional area is steadily reduced in the direction of flow over an angle of about 360° from a location at said chamber inlet (broken line in FIG. 2) to almost zero (broken line in FIG. 2); and g. a discharge passage communicating with said chamber and said discharge opening in said bottom wall of said housing and having a substantially uniform cross sectional area throughout its length, whereby liquid will exit said spiral chamber in a smooth unbroken flow with an angular component which causes the liquid to flow down the interior sides of the container due to the angular momentum imparted by the spiral chamber.

2. A filling device as described in claim 1 comprising:

a. said chamber top wall (3) and bottom wall (4) are horizontal and parallel to each other and said chamber wall (2) is in the shape of a logarithmic spiral; and b. said spiral chamber inlet opening (broken line in FIG. 2) has a width substantially equal to said diameter of said discharge opening in said bottom wall of said housing.

3. A filling device as in claim 1 comprising:

a. shut off valve means (15) mounted for reciprocation in said housing and formed with a sealing member (14) for registration with said discharge opening (6) and formed with an air tube therethrough.

4. A filling device as described in claim 3 comprising:

a. said inlet opening (5) is formed in said top wall (3), offset from said discharge opening (6);

b. a dividing wall (9) positioned in said chamber essentially parallel to said top wall (3) and said bottom wall (4), dividing said chamber into upper and lower sections and said dividing wall has an outlet opening (10) in approximate alignment with said discharge opening (6), and an inlet opening (11) in alignment with said inlet opening (5);

c. a sleeve valve (12) mounted for registration with and reciprocation through said openings (5) and (11) and having a wall for sealing registration with said housing bottom wall for providing fluid to enter either said lower section of said chamber or to enter both said upper and lower sections of said chamber; and d. said shut off valve (15) extends through said opening 10 in said dividing wall (9).

* * * * *